US011293620B1

(12) United States Patent
Murray

(10) Patent No.: US 11,293,620 B1
(45) Date of Patent: Apr. 5, 2022

(54) METHODS AND SYSTEMS FOR WATER VESSEL LIGHTING DEVICES

(71) Applicant: Cameron Merle Murray, Beaumont, CA (US)

(72) Inventor: Cameron Merle Murray, Beaumont, CA (US)

( * ) Notice: Subject to any disclaimer, the term of this patent is extended or adjusted under 35 U.S.C. 154(b) by 0 days.

(21) Appl. No.: 17/304,435

(22) Filed: Jun. 21, 2021

(51) Int. Cl.

| | |
|---|---|
| ***F21S 43/00*** | (2018.01) |
| ***F21S 43/15*** | (2018.01) |
| ***F21S 43/14*** | (2018.01) |
| ***F21S 45/50*** | (2018.01) |
| ***H05B 47/19*** | (2020.01) |
| ***B63B 45/04*** | (2006.01) |
| ***H05B 45/20*** | (2020.01) |
| *F21W 107/20* | (2018.01) |
| *F21Y 115/10* | (2016.01) |
| *F21Y 113/13* | (2016.01) |

(52) U.S. Cl.
CPC ..... *F21S 43/15* (2018.01); *B63B 45/04* (2013.01); *F21S 43/14* (2018.01); *F21S 45/50* (2018.01); *H05B 45/20* (2020.01); *H05B 47/19* (2020.01); *B63B 2201/08* (2013.01); *F21W 2107/20* (2018.01); *F21Y 2113/13* (2016.08); *F21Y 2115/10* (2016.08)

(58) Field of Classification Search
CPC ..... B63B 45/04; H05B 47/19; H05B 45/20; F21S 45/50; F21S 43/15; F21S 43/14
See application file for complete search history.

(56) References Cited

U.S. PATENT DOCUMENTS

| | | | | |
|---|---|---|---|---|
| 4,429,350 | A * | 1/1984 | Guthrie | F21L 14/00 362/109 |
| 6,155,195 | A * | 12/2000 | Nirenberg | B60Q 1/2657 114/343 |
| 7,758,219 | B2 * | 7/2010 | Burke | G02B 6/0008 362/477 |
| 7,964,741 | B2 | 5/2011 | Nichols | |
| D783,191 | S | 4/2017 | Riffner | |
| 10,399,649 | B1 * | 9/2019 | Tate | B63B 45/02 |
| D880,026 | S | 3/2020 | Riffner | |
| 10,701,922 | B1 * | 7/2020 | Larsson | F21S 4/26 |

(Continued)

OTHER PUBLICATIONS

Xprite 4FT RGB Spiral Bluetooth Whip Lights with APP & Wireless Remote Control. on sale Dec. 28, 2020 (Year: 2020).*

(Continued)

*Primary Examiner* — Gerald J Sufleta, II
(74) *Attorney, Agent, or Firm* — Knobbe, Martens, Olson & Bear LLP

(57) ABSTRACT

A lighting system is disclosed that may be used for marine applications. The lighting system comprises a light strip support structure, a first light strip comprising a first plurality of lighting elements, including light elements of different colors, a second light strip comprising a second plurality of lighting elements, the second light strip positioned above the first light strip and configured to emit only white light, a light element controller electrically connected to the first light strip, wherein the light element controller is configured to control the illumination of the first plurality of lighting elements and not the second plurality of lighting elements and a connector configured to mate with a watercraft stern connector.

28 Claims, 11 Drawing Sheets

(56) References Cited

U.S. PATENT DOCUMENTS

| | | | | |
|---|---|---|---|---|
| 2001/0036082 | A1* | 11/2001 | Kanesaka | B63B 45/02 362/555 |
| 2005/0162850 | A1* | 7/2005 | Luk | F21S 4/26 362/227 |
| 2010/0096991 | A1* | 4/2010 | Burke | B63B 45/04 315/77 |
| 2011/0242819 | A1* | 10/2011 | Mitchell | B60Q 1/0483 362/311.02 |
| 2013/0076269 | A1* | 3/2013 | Shilton | H05K 13/00 315/360 |
| 2015/0274267 | A1* | 10/2015 | Deven | F21V 31/005 362/477 |
| 2015/0285472 | A1* | 10/2015 | Evitt | F21V 23/06 362/224 |
| 2018/0334232 | A1* | 11/2018 | Poole | B63B 45/04 |
| 2020/0281334 | A1* | 9/2020 | Johnson | A61H 3/068 |
| 2020/0290710 | A1* | 9/2020 | Edwards | B60Q 1/32 |
| 2021/0147044 | A1* | 5/2021 | Beers | H05B 45/20 |

OTHER PUBLICATIONS

187 Boat Stern Light—5150 Whips Inc., https://5150whips.com/collections/all/products/187-boat-stern-light, in 4 pages, Copyright 2021.

2x LED whips w/Bluetooth—5150 Whips Inc., https://5150whips.com/collections/all/products/2-led-whips-w-bluetooth-4ft, in 3 pages, Copyright 2021.

2x LED Whips w/Wireless Remote—5150 Whips Inc., https://5150whips.com/collections/all/products/copy-of-2x-led-whips-w-wireless-remote, in 3 pages, Copyright 2021.

* cited by examiner

METHODS AND SYSTEMS FOR WATER VESSEL LIGHTING DEVICES

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field

The field of the instant disclosure relates to lighting devices, and in particular, lighting devices for water vessels.

Description of the Related Art

Marine vessels operating at night are typically required to display a white stern (rear) light between sunset and sunrise, or in periods of restricted visibility. Depending on vessel size and type, the minimum stern light requirements differ and hence stern lights need to be specifically designed and configured for given vessel sizes and types. Conventionally, this increases the consumption of design, manufacturing, and storage resources. Further, reuse of a given stern light is restricted to a small subset of appropriate vessels. Yet further, conventional stern lights provide only a single lighting function.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

An aspect of the present disclosure relates to a lighting system, optionally configured for marine applications such as a stern light, the lighting system comprising: a light strip support structure; a first light strip comprising a first plurality of lighting elements, including light elements of different colors, the first light strip optionally wrapped around the light strip support structure in a spiral manner; a second light strip comprising a second plurality of lighting elements including lighting elements that emit only white light, the second light strip optionally wrapped around the light strip support structure above the first light strip in a spiral manner; a light element controller electrically connected to the first light strip, wherein the light element controller is configured to control the illumination of the first plurality of lighting elements of the first light strip and not the second plurality of lighting elements of the second light strip; a moisture resistant structure enclosing at least portions of the light strip support structure, the first light strip, and the second light strip; and an electrical connector configured to mate with a watercraft connector.

An aspect of the present disclosure relates to a lighting system, optionally configured for marine applications such as a stern light, the lighting system comprising: a light strip support structure; a first light strip comprising a first plurality of lighting elements, including light elements of different colors; a second light strip comprising a second plurality of lighting elements, the second light strip positioned above the first light strip; a light element controller electrically connected to the first light strip, wherein the light element controller is configured to control the illumination of the first plurality of lighting elements and not the second plurality of lighting elements; and a connector configured to mate with a watercraft stern connector.

BRIEF DESCRIPTION OF THE DRAWINGS

Embodiments will now be described with reference to the drawings summarized below. Throughout the drawings, reference numbers may be re-used to indicate correspondence between referenced elements. The drawings are provided to illustrate example embodiments described herein and are not intended to limit the scope of the disclosure.

DESCRIPTION

Figure 1:
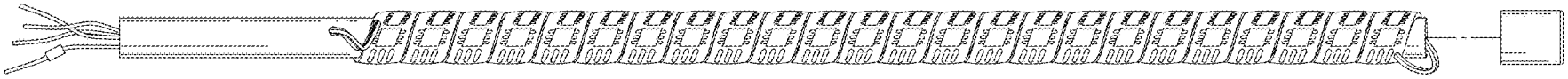
FIG. 1 illustrates a first example configuration of a light assembly.

As similarly discussed above, vessels operating at night are typically required to display a white stern (rear) light between sunset and sunrise, or in periods of restricted visibility. Depending on vessel size and type (e.g., sailboat, power boat, etc.), the minimum stern light requirements differ and hence conventionally stern lights need to be specifically designed and configured for given vessel sizes and types.

Disclosed herein is a stern light assembly that can be dynamically reconfigured and is suitable for a wide variety of vessel/watercraft sizes and types and/or for a variety of uses. The stern light may be used as a running light, an emergency light, to illuminate the stern of the vessel (e.g., to enable passengers to walk, eat, or perform other activities in the stern of the vessel), and/or for an entertaining light show.

Optionally, the stern light is configured to operate off available DC power typically provided by watercraft (e.g., 12V). To enhance reliability and light emission, while reducing size, the stern light may optionally utilize LEDs as a light source. The resulting stern light may be configured to meet or optionally exceed minimum applicable regulatory lighting requirements for a wide variety of ship types and sizes. The disclosed stern light may be configured to provide more light, greater reliability, and enhanced safety as compared to conventional stern lights while the vessel is parked, anchored or in route on the water.

Optionally, in addition to providing enhanced light output as compared to conventional stern lights, the disclosed stern light may include multiple colors of light emitters (e.g., LEDs), such as white, red, green, blue, cyan, yellow, amber, orange, peach, purple, pink, and/or forest green. Optionally, the disclosed stern light may include a programmable controller (e.g., a microcontroller, microprocessor, state machine, etc.) that can selectively control which color(s) of lighting elements are to be turned on so as to emit light, thereby enabling an attractive and distinctive light to be emitted. Further, optionally the programable controller may be configured to selectively pulse individual lighting elements (e.g., LEDs) or sets of lighting elements of one or more colors on and off at a specified period to enable a variety of highly visible and attractive lighting effects. Such example lighting effects may include dancing lights, chasing lights, rainfall, strobing of lights, pulsing, and corresponding speeds (e.g., rate of change of the effects, such as how quickly the "drops" fall, how quickly the lights "chase" each other, how quickly the lights will pulse on and off, etc.).

In addition, the controller may be configured to control the brightness of individual and/or sets of lighting elements. Yet further, the controller may be configured with an auto-off feature, where the controller turns off the lighting elements after a pre-set amount of time (e.g., 15 minutes, 30 minutes, 2 hours, or other time). As discussed elsewhere herein, some or all of the foregoing effects and features may be manually controlled by a user via a remote control device The lighting elements may be in the form of durable and high-power LED indicator devices. The LEDs may be affixed to a rigid or flexible light strip. Advantageously, the stern light may optionally be configured so that failure of a given lighting element on the light strip will not affect the operation (e.g., the illumination) of the other lighting elements, thereby providing enhanced safety, particularly at night in the event of a failure condition.

A given LED may include a semiconductor chip or die, a substrate (e.g., a ceramic substrate) to which the die is affixed, contacts to apply power, bond wire to connect the contacts to the die, a heat sink, lens, and outer casing. Different LED materials may be used to cause respective LEDs to emit light in a corresponding color, such as white, red, green, cyan, yellow, amber, orange, peach, purple, pink, and/or forest green. The LEDs may be mounted to a flexible substrate, such as a flexibly printed circuit board (PCB). The LEDs may be encapsulated using elastomeric encapsulation. The PCBs may be daisy chained to enable multiple LEDs light strips to be wired together via respective leads or connectors and to be controlled as if they were a single light strip.

As will be discussed, the light strip may be mounted in a planar or spiral fashion (to provide radially projecting light) to a support structure, such as a tube or pole (e.g., comprised of a composite material (e.g., carbon fiber, fiberglass, Kevlar®, etc.), aluminum, PVC, fiberglass, or other material). Optionally, the lighting strips may be wrapped around the exterior surface of a support structure or may be mounted to the inside surface of a support structure (e.g., a tube enclosure), such as between ridges from on an interior of a tube. An adhesive (e.g., glue or an adhesive tape) may optionally be used to securely fix the light strips on the enclosure tube or to the central support structure. Thus, the light strips may optionally be mounted to an interior of a tube, or wrapped around the exterior of a tube.

Optionally, the tube may be hollow and may accommodate wiring internally. Optionally, one or more LEDs lighting elements may be positioned on the tube to illuminate in an upwards direction, a substantially horizontal direction, and/or a downward direction.

Optionally, in order to comply with regulations and/or to enhance safety, lighting elements in an upper region of the stern light (e.g., the top 2"-12", or more particularly the top 3"-5", or about 4") may be configured differently and controlled differently than the lower positioned lighting elements. For example, the color of the upper region lighting elements may be required to be white and shine aft and 67.5° (or other angle) forward on each side, and have a visibility range of 2 miles. Thus, the controller may be prevented from changing the color of the upper region lighting elements from white, and/or the upper region lighting elements may only include white lighting elements. Optionally, the controller is not connected to the upper region lighting elements, and the upper region lighting elements receive power from the stern light connector without an intervening manual switch or controller.

Thus, optionally, light elements in the upper region are not user controllable at all once plugged into the stern base receiving connector by a user. Instead, as soon as the stern light is plugged into a stern base receiving connector, the upper region lighting elements will be automatically powered and turned on, providing immediate white light illumination (assuming that the marine vessel is providing power). The upper region light elements will automatically remain in the illuminated state, without interruption, the entire time the stern light is plugged into the stern base (assuming the vessel is providing power), and optionally no provision is provided to enable the user to turn off the light (e.g., via a remote control device or local controls) or change the color of the light. Thus, in order to turn off the upper region lighting elements, the user needs to disconnect or turn off the vessel power, or unplug the stern light from the stern base receiving connector, thereby enhancing navigation safety.

Optionally, the stern light may be equipped with a light sensor and/or rain sensor. In response to detecting that the visibility is poor (e.g., in response to detecting that it is night time or otherwise dark or raining/foggy), the controller may turn off the lighting elements below the upper region and prevent the lighting elements below the upper region from being turned on. The foregoing features may enhance safety and enable safety regulations to be complied with.

A connector, wired to the light strip(s) to connect the light strip to a power source, may be provided at one end of the stern light to securely mount the stern light in an upright position to a stern of a water vessel. For example, the connector may be a 2-prong receiving connector (having cylindrical hollow pins) configured to mate with a stern light pole base connector having to protruding pins.

The controller device may need to have power applied with the correct polarity (e.g., ground terminal connected to power source ground, and positive/"hot" terminal connected to power source positive/"hot"). To ensure that the stern light is inserted with the correct orientation so that the ground pin of the stern light is connected to the stern light connector may optionally be keyed to mate with the base with the base connector at a desired orientation. The stern light connector may be configured to position the stern light at a desired angle (e.g., 0 degrees from the vertical axis, 10 degrees from the vertical axis, 15 degrees from the vertical axis, or other desired angle).

Optionally, the stern light controller may be configured to receive commands from a wired or wireless remote control device. The remote control device may be sized to be handheld and/or may be mounted to a vessel surface. The remote control device may include physical buttons, or a touch screen with soft and/or programmable buttons via which a user can provide instructions to control lighting effects, such as dancing, chasing, rainfall, strobe, pulse, and lighting effects speed. In addition, the remote control device may be configured with buttons or other user interface controls to enable a user to control the brightness of individual and/or sets of lighting elements. Optionally, the user interface may enable the user to increase or decrease the brightness in predefined step increments (e.g., 3, 5, or 10 step increments) or continuously. Optionally, the user interface may enable the user to increase or decrease the effect speed in predefined step increments (e.g., 3, 5, or 10 step increments) or continuously. Yet further, the remote control device may be configured with buttons to enable a user to activate and set a time value for an auto-off feature, where the controller turns off the lighting elements after a commanded period of time (e.g., 15 minutes, 30 minutes, 2 hours, or other time) corresponding to an shut off button or other control activated by a user.

Optionally, the remote control device may be in the form of a multi-purpose device (e.g., a mobile smart phone or tablet) having a remote control application (an "app") installed and hosted thereon. The remote control application may present a user interface configured to receive the user instructions (e.g., via soft buttons/slide controls, via voice, or otherwise). Optionally, the remote control device may be configured to receive and process voice commands, and issue corresponding commands to the controller.

The stern light controller may be configured to receive remote control commands via Bluetooth, WiFi, infrared, and/or other communication protocol or medium.

The stern light may be configured with one or more lengths (where the pole has a corresponding length). For example, the stern light may be configured to have a length of 24 inches, 12 inches, 32.5 inches, 44.5 inches, 0.5 meters, 1 meter, 1.5 meters, or other desired length. Different lengths may be suitable or mandated for different types of vessels (e.g., motor, sail, etc.) and/or vessel lengths (e.g., greater than 21 feet, 21 feet or less).

A protective enclosure, such as a tube or shrink wrap (which may be in the form of a heat shrink tube), may be utilized to protect the lighting elements, controller, and other circuitry. The protective enclosure may be hollow, transparent or semi-transparent. Where the enclosure is a tube, tube may be cylindrical in shape, although other shapes may be used, such as a prism or an elongated rectangle, square, or oval. Where the enclosure is a shrink wrap, the shrink wrap material made comprise a substantially transparent polymer plastic film. When heat is applied, the shrink wrap may shrink tightly over the lighting elements (which may be mounted to an internal support structure, such as a tube or rod). For example, a handheld heat gun or heat tunnel may be utilized to apply the heat.

Certain aspects will now be described with reference to the figures. Although the figures may provide example illustrative dimensions, other dimensions may be utilized.

Referring to FIG. 1, an example stern light configuration is illustrated. As illustrated, a light strip is spirally wrapped around a pole. The light strip may include light sources, such as LEDs, periodically spaced. For example, the light sources may be spaced with a range of about ¼"-1" (e.g., ⅞") intervals on the light strip. When wrapped around the pole, the vertical distance between light elements may be in a range of about ⅜"-⅞" (e.g., ⅝") for the planar configuration. The vertical distance between light elements may be in a range of about ¼"-12/16" (e.g., ½" vertical with an LED strip wrap spacing from LED to LED of about 9/16" on center) or about ⅜" vertical with a tight spiral wrap (e.g., where the LED strip has no spacing between wraps, thereby providing an LED-to-LED spacing of about 7/16" on center.

As discussed above, in order to protect the light elements and associated circuitry and wiring from the environment (e.g., water, salt, dirt, etc.), the light elements and associated circuitry and wiring from the environment may be included in a protective shield, such as shrink wrap or a tube open on both ends. In addition, a tube may optionally be used as a central support structure for the lighting element strips. The tube may have a hard, resilient surface. The tube may comprise a clear or translucent polycarbonate, plastic, plastic composite type, fiberglass, and/or carbon-fiber material. Optionally, tube may be in the form of a long cylinder shape (with a hollow interior). Although the tube is configured to be hard when pressure is exerted about the circumference, the tube may have has flex from end to end.

An appropriate tube length (whether used as a support structure or as a protective enclosure) may be selected for a given application, vehicle type, and/or vehicle length. For example, the tube length may be in the range of 20"-48" (e.g., about 32.5" or 44.5" in length), or other length. The tube outside diameter may be sized of fit around the pole and lighting elements. For example, the tube may optionally have an outside diameter in the range of ⅜"-¾" (e.g., ⅝"), with a tube wall thickness optionally in the range of 1/32"-3/16" (e.g., ⅛").

The tube may optionally have a diameter in the range of ⅝"-1" (e.g., ⅝").

An orifice (e.g., a circular orifice) may be formed near the bottom end of the tube (e.g., within a range of 0.5"-4", such as approximately 2.5" from the bottom end of the tube). The orifice diameter may have a diameter in the range of 1/16"-8/16" (e.g., 3/16").

As illustrated, an endcap may be used to seal the top of the tube to protect against the environment (e.g., rain, salt water, dirt, etc.) and to enhance safety (e.g., to prevent a user inserting a finger or object into the tube). The endcap may be flexible. For example, the endcap may be made of a soft, elastic material, such as vinyl, rubber, or a rubber-like durable material. Optionally, the endcap may be cuttable using a scissor, utility knife, or other cutting device, so that the endcap can be cut to appropriate lengths as required (if needed). The flexible endcap may be sized so that when over or inserted into the tube end it will be firmly fixed in place (e.g., a friction fit). Optionally, the endcap may be glued in place using an adhesive, caulked, and/or tape may be wrapped around the endcap and tube end to further fix the endcap in place.

The endcap may have a shape corresponding to the tube opening. For example, the endcap may have a round/circular distal end, open on the bottom side and closed off on the top. The endcap diameter may range from ⅝"-1" (e.g., ⅝"-1") depending on model size and type.

The combination of the shrink wrap (which may be tape or a heat shrink tube), tube, endcap, and/or sealant/caulk may make the stern light waterproof or water resistant. Further, the tube, when used as a protective enclosure, may comprise a material and surface that makes it resistant to scratches and abrasions so as to preserve its optical qualities and transparency. For example, the shrink wrap/tube may comprise clear polyvinyl chloride tubing. Furthermore, the tube surface may be treated to reduce salt deposits from salt water. For example, an ethanol-based, non-stick, essentially invisible nanotechnology protective coating that acts as a water repellant may be applied to the exterior and/or interior surface of the tube to reduce salt from depositing there on.

The coating may cause water on the tube surface to bead up into small beads which may then swept off the tube surface by a breeze or wind, providing enhanced light transmissivity in wet conditions So as to further protect the stern light from the environment, the light strip themselves may be waterproof or water resistant (e.g., having a waterproof rating of 5050 IP67). To yet further protect the stern light from the harsh marine environment a waterproof silicone, glue, or caulking may be applied on and/or in the base of the tube to seal the bottom. A clear or translucent marine-grade shrink wrap may be wrapped along the outside of the light element portion of the stern light, a heat-shrink cap may be placed on the top of the tube, and/or an outer shrink wrap may be applied where the light strip connects to the bottom connector, thereby further protecting the lighting elements from the water and salt environment.

Referring to FIG. 1, an example stern light configuration is illustrated. Although example dimensions are provided for illustrative purposes, other suitable dimensions may be used. In the illustrated implementation, a central support structure (e.g., a tube) is mounted to a lower base portion (e.g., a lower tube), using a punch, press fit, a screw, an adhesive, and/or other technique. Optionally, the central support structure may be of a different material (e.g., a composite or plastic tube) than the lower base portion (e.g., metal, such as stainless steel or a chromed metal). This enables the central support structure to be relatively light, while ensuring the lower base portion is very strong and rigid.

A controller (e.g., an LED controller) may be positioned in or lower than the lower base portion of the stern light, receiving power via wires connected to positive and negative power pins, as discussed elsewhere here. The controller may further be wired to the light strips (e.g., LED light strips), which is this example are wrapped around the support structure, to control the lighting element colors and effects (e.g., dancing, chasing, rainfall, strobing, pulsing, speed of the foregoing, etc.). Optionally, as described elsewhere herein, the controller is not connected to the upper region of lighting elements, where the upper region lighting elements are automatically illuminated (e.g., providing white light) when power is applied without the controller being able to control any aspect (e.g., brightness, color, effects, illumination, etc.) of the upper region of lights.

As illustrated, an orifice may be positioned towards the bottom of the support structure and an orifice may be positioned towards the top of the lower base portion tube to thereby enable some or all of the electrical wires to be feed into the tube. Further, light strip wiring for the top region lighting elements may be feed from the lower base portion to the lighting elements on the support structure. The wiring may optionally run up the inside of the support structure. A top endcap may then be inserted into or over the top of the tube to seal the tube against the environment.

Figure 2:
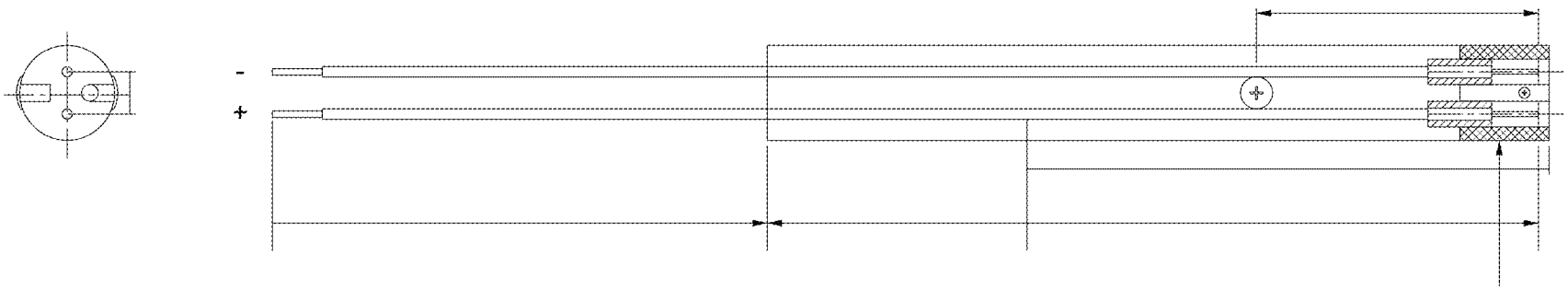
FIG. 2 illustrates an example base assembly diagram.

FIG. 2 illustrates an example mechanical assembly diagram, including a lower base portion N (e.g., a stainless steel tube, which may be opaque), a base connector M, receiving cylindrical pin sockets L (configured to receive power pins in the stern receiving base), a punch P configured to fix the connector M into the base portion N (so that a screw is not needed to fix the connector into the base portion, thereby reducing the possibility of a screw working its way out, which would allow the connector M to fall out of the tube N), a threaded screw hole O (of which there may be two on opposite walls of the base tube N) configured to receive screws to removably fix the stern light assembly in the stern base receiving connector mounted to the vessel, positive and negative/ground wiring C, K, and threaded, windings/ridges Q configured to act as a press fit for the upper support structure to which the lighting elements are affixed (to thereby retain the support structure without the use of failure-prone screws). The lower base portion N may have a logo etched or molded thereon.

Figure 3:
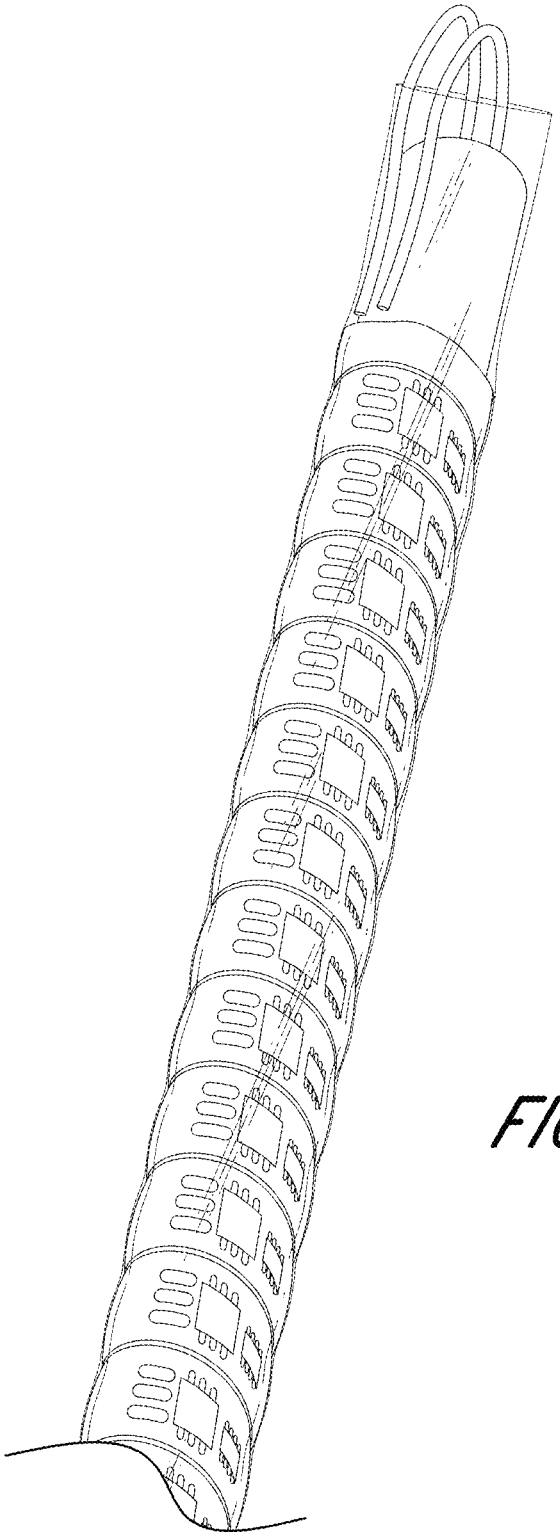
FIG. 3 illustrates a first example light configuration with spirally wound lighting elements.

FIG. 3 provides an illustration of an LED light strip (which may include multiple light strips) wrapped in a spiral fashion around a tube or other support structure, where the light strip assembly/support structure are wrapped in shrink wrap, to form a water proof or water resistant stern light assembly. Advantageously, by wrapping the light strip in a spiral manner around the tube (or other internal support structure) the density of lighting elements per square inch is increased relative to a planar implementation, and more LED lighting elements are provided. Thus, with the same or about the same size stern light (in terms of height and/or diameter) using the same type of lighting elements with the same light output, the spiral configuration provides a higher overall light output. Further, the spiral configuration enables additional lighting effects to be generated (e.g., lights that appear to run around and up the stern light).

Figure 4:
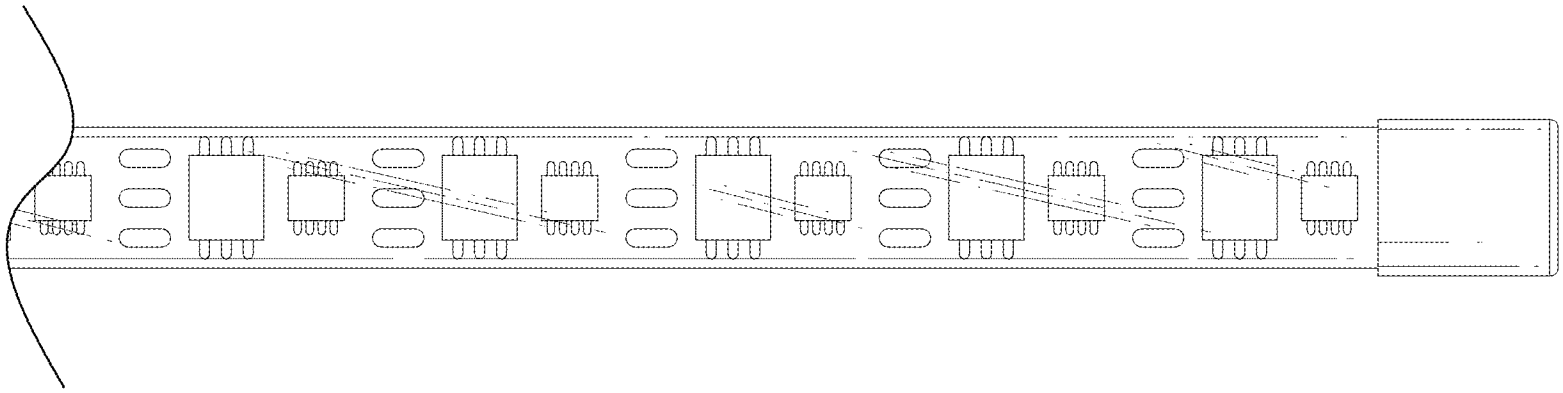
FIG. 4 illustrates a first example light configuration with planar-mounted lighting elements.

FIG. 4 provides another illustration of an LED light strip (which may include multiple light strips) mounted in a planar fashion to an interior surface of an enclosure tube (e.g., between ridges formed on the interior surface of the tube, and/or optionally using adhesive) to form a stern light assembly. In this illustration, a top endcap has been inserted over the top end of the tube. Optionally, rather than being mounted to the internal surface of the enclosure tube, the light strip may be mounted on a support structure (e.g., a tube) and may then be protectively enclosed using shrink wrap or an enclosure tube. The planar implementation advantageously uses less power than the equivalent spiral implementation, may generate less heat, and may be easier to assemble.

Figure 5:
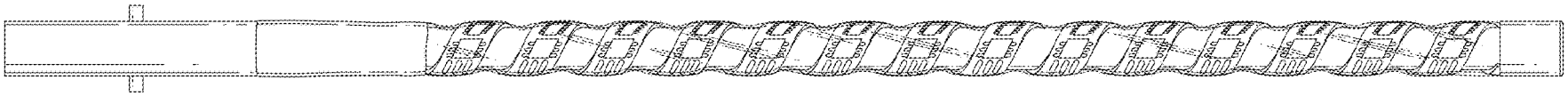
FIG. 5 illustrates the first example light configuration illuminated.

FIG. 5 illustrates an example stern light, using the spiral light strip configuration, when illuminated. Different portions of the stern light may be illuminated in different colors, patterns, and/or effects (e.g., dancing, chasing, rainfall, strobing, and/or pulsing, and corresponding speeds) at the same time (e.g., a blue and white spiral, a red and white spiral, all white, etc.).

Figure 6:
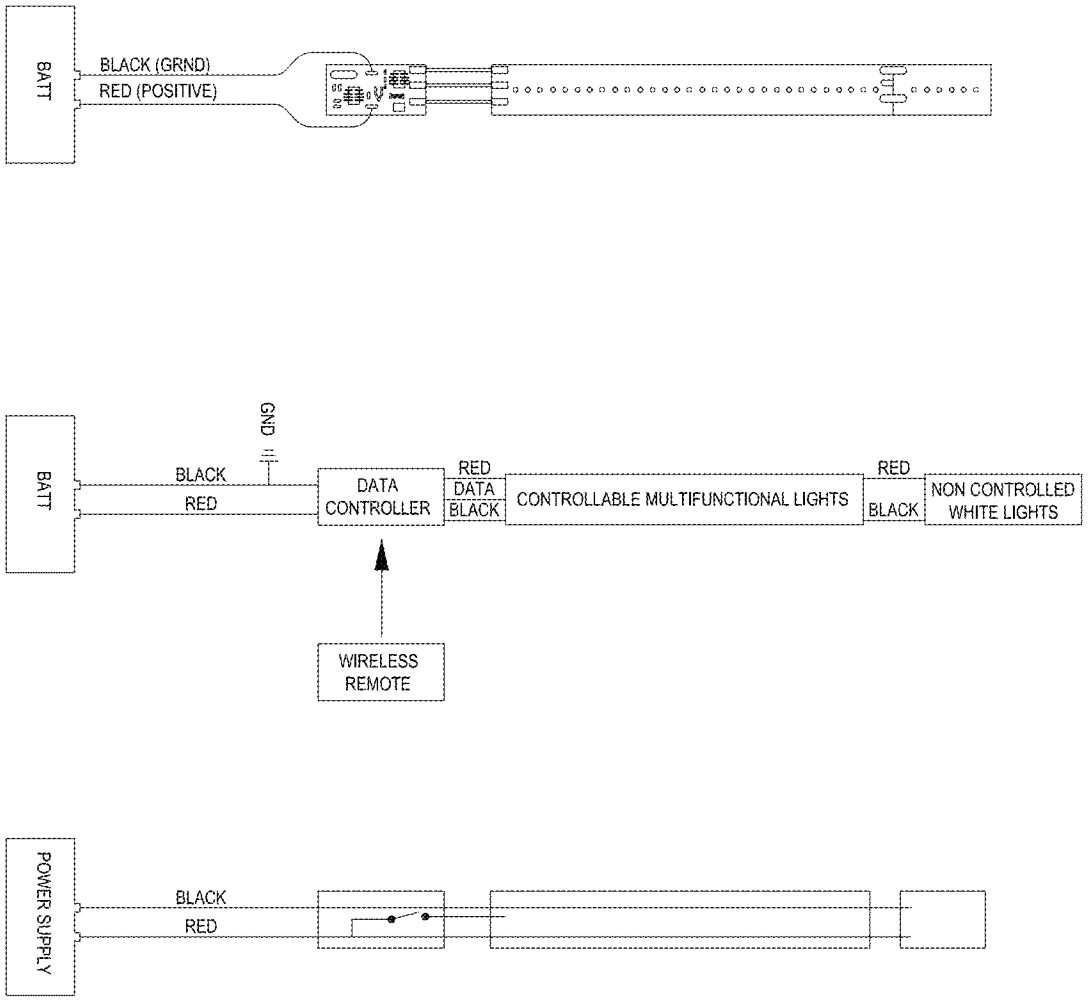
FIG. 6 illustrates example light assembly wiring diagrams.

Referring now to FIG. 6, example wiring diagrams are illustrated. In the first wiring diagram on the leftmost side, power (e.g., DC power from a water vessel battery) is connected to a controller device. The controller device may be polarity sensitive, where the positive conductor of the power source is connected to the positive terminal of the controller, and where the ground/negative conductor of the power source is connected to the ground/negative terminal of the controller. Thus, for certain controller devices, the controller device will not operate and may be damaged if the power terminals are not connected to the corresponding power source conductors and are instead reversely connected. The controller device has a DC power output (e.g., 12V) with ground and positive terminals correspondingly electrically coupled to the ground and positive terminals of the lower, controllable multi-effect, multicolored light strip (s). The ground and positive terminals of the lower light strip(s) may be positioned towards the lower end of the lower light strip.

The controller device has a data terminal connected to a corresponding data terminal of the lowest light strip(s). An upper light strip(s), which may be configured to only illuminate with white light, may have its power terminals (located towards the lower end of the upper light strip) daisy chained with respect to the lower light strip, where the power terminals of the positive and ground terminals of the upper light strip are connected to corresponding terminals located on an upper end of the lower light strip. However, the upper light strip may not have a data input (or it may have a data input that is not connected to the controller) and so may not be controlled by the controller device. Instead, the upper light strip will immediately illuminate with a white light as soon as power is supplied, thereby enhancing safety and compliance with boating regulations. The controller device may optionally be encapsulated or enclosed in a package to further protect it from moisture and dust.

The second, middle wiring diagram is an interconnect diagram illustrating the first diagram from a functional viewpoint. A remote control device (e.g., a wireless remote control device) may transmit commands to the data controller device as described elsewhere heroin. The third diagram illustrates the electrical conductors and interconnects.

As discussed elsewhere herein, the controller device may be polarity sensitive, in that the positive terminal of the controller device needs to be electrically connected to the positive side of the power source, and the ground/negative terminal of the controller device needs to be electrically connected to the ground/negative side of the power source in order to operate the controller device. However, different vessels may have their stern base receiving connectors wired differently. For example, a more forward power pin (closer to the vessel bow) on the stern base receiving connector may be wired to the positive side of the power source on certain vessels while the more rearward power pin (stern side of the vessel) may be connected to the negative/ground side of the power source. By contrast, on other vessels, the more rearward power pin on the stern base receiving connector may be wired to the positive side of the power source on certain vessels while the more forward power pin may be connected to the negative/ground side of the power source. Because conventional stern lights do not have a controller device, conventional stern lights may not be concerned with polarity issues.

Figure 7:
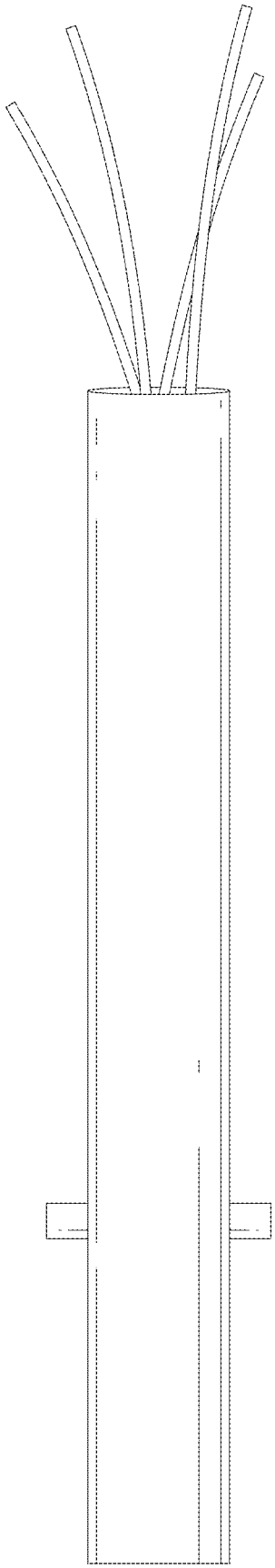
FIG. 7 illustrates an example light assembly base component.

In order to enable the stern light to be used with different vessels having different power wirings, the base of the stern light may have two predrilled holes on either side of the lower base portion as illustrated in FIG. 7. The receiving connector on the stern of the vessel typically has a single screw to screw through the receiving connector to a threaded screw bore drilled into the stern light. Thus, conventionally, typical stern lights have only one receiving threaded screw bore. By contrast, having two such threaded screw bores, the stern light can be rotated 180 degrees if needed to ensure the correct orientation of the stern light power pins, where a screw bore will still be positioned to receive the set screw. Thus, the predrilled holes may be used to enable the stern light to be inserted into the stern base receiving connector with the correct orientation, and ensure that the stern light's power terminals are connected to the appropriate power source conductors. Although the lower base portion is depicted with two screws on either side of the lower base portion for illustrative purposes, typically, only one screw on one side of the lower base portion will be screwed in when mounted in a vessel, as typical vessels are only provisioned with one threaded bore to receive a set screw.

Figure 8:
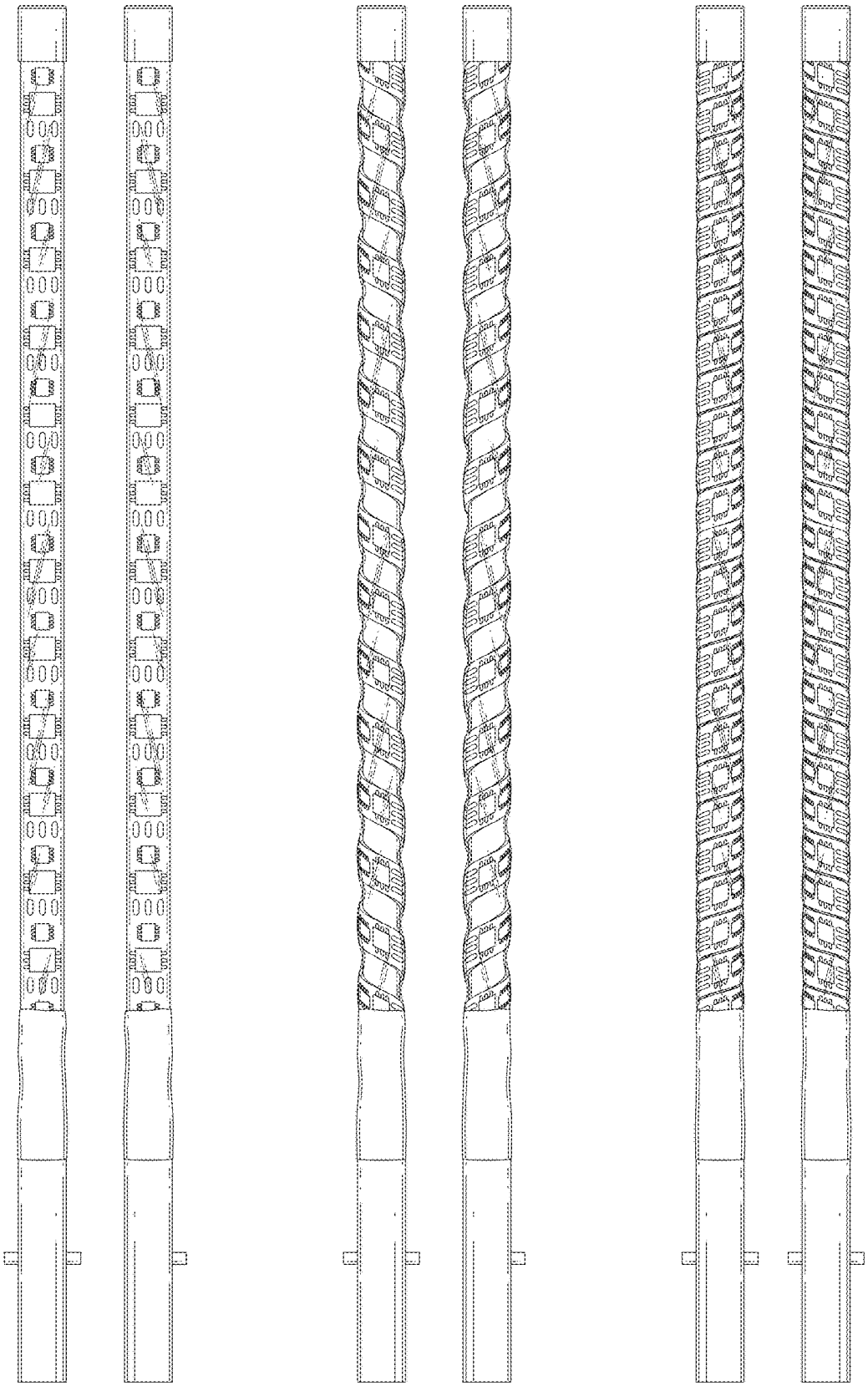
FIG. 8 provides additional depictions of example light configurations.

FIG. 8 illustrates example stern light assemblies (with light element strips A mounted in a planar manner and with light element strips H mounted in a spiral manner) with shrink wrap therearound, with the lower base portion N assembled with the upper portion A comprising the lighting elements, where an opaque shrink wrap R, S is shrunk around the seam between the lower and upper portions. The shrink wrap around the seam advantageously prevents moisture and salt from penetrating to the interior of the lower and upper portions. Screw receiving orifices O are provided in the base portion.

Figure 9:
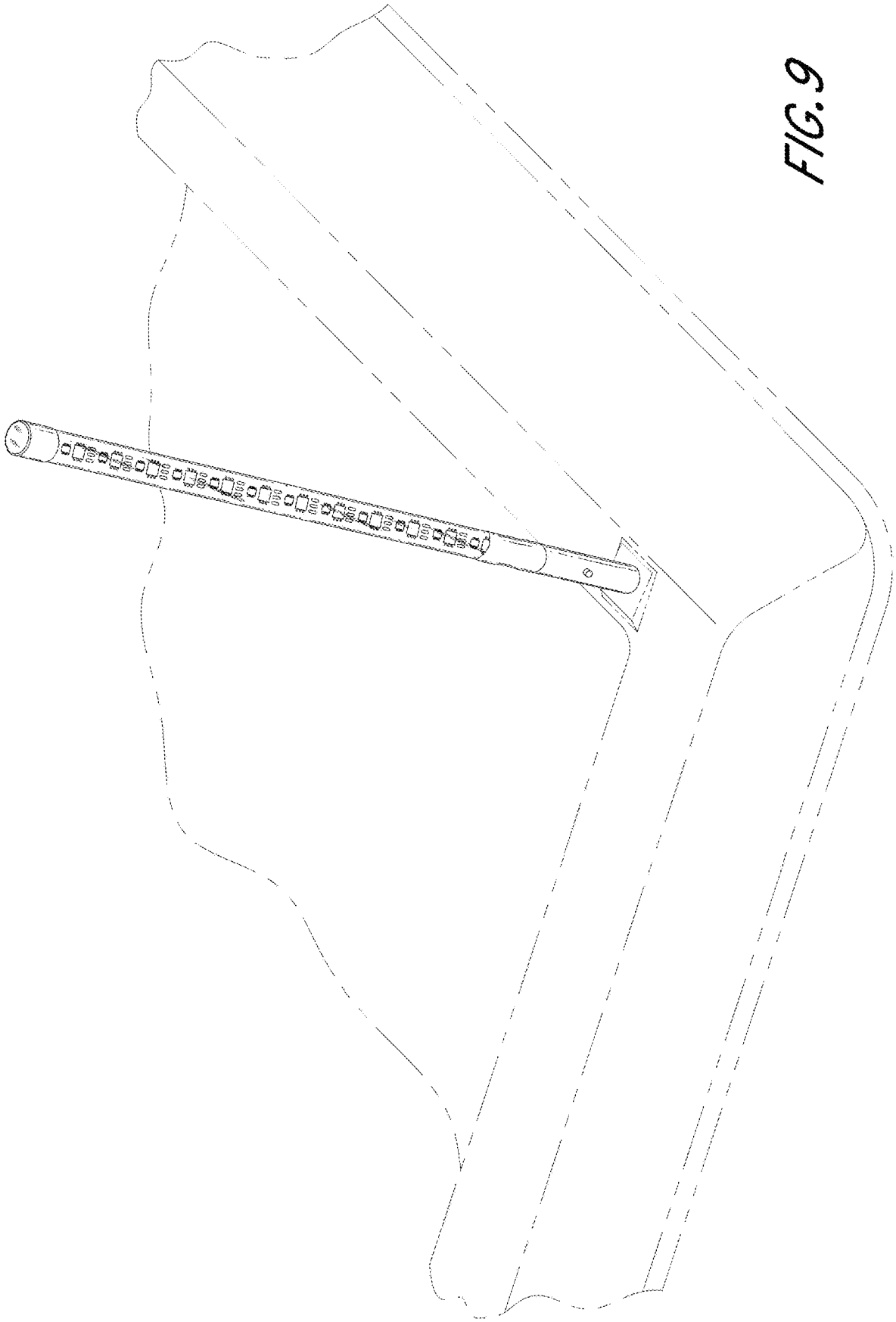
FIG. 9 illustrates an example light assembly mounted to the stern of a water vessel.
Figure 10:
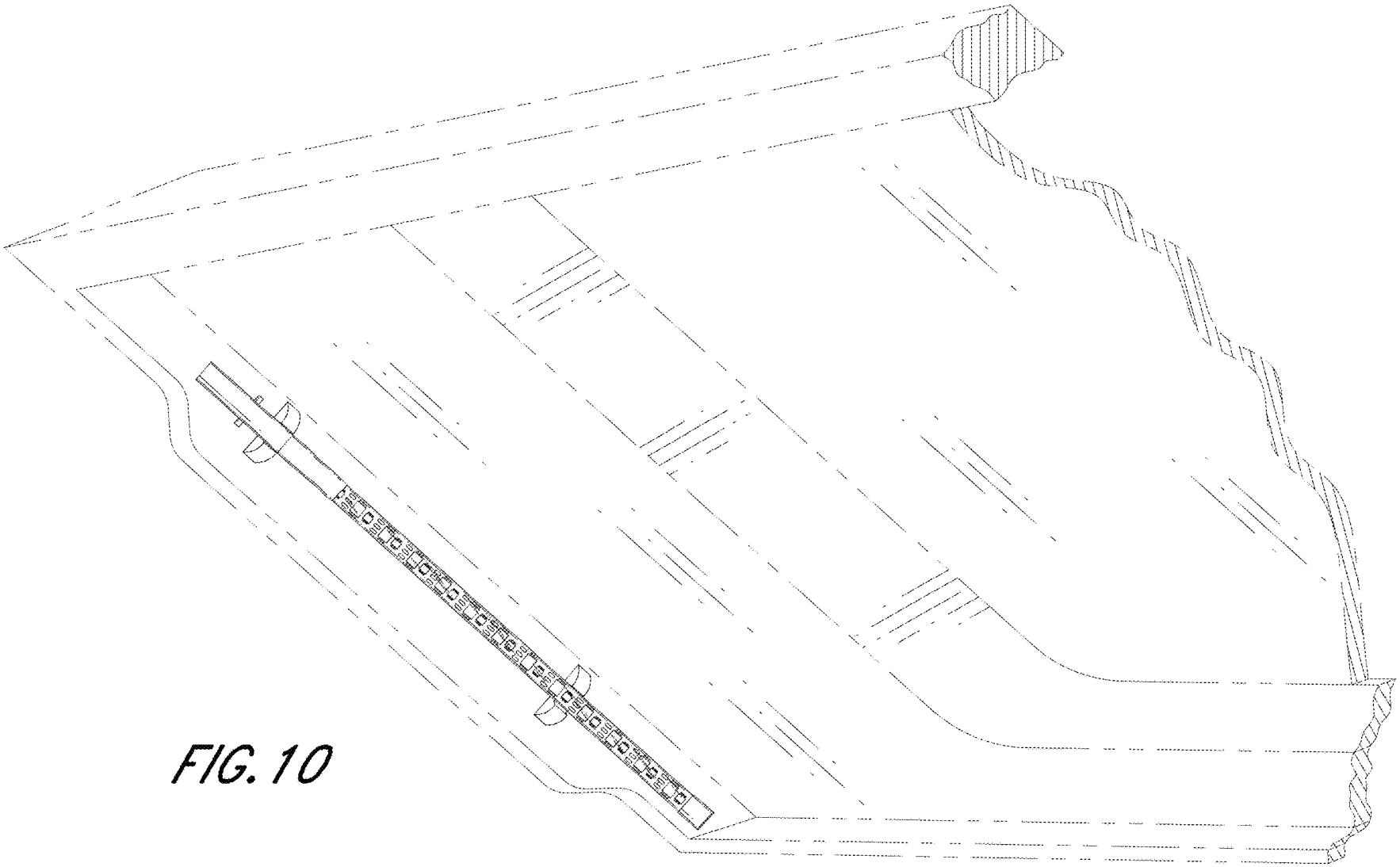
FIG. 10 illustrates a lighting assembly storage mount.

FIG. 9 illustrates an example of the stern light inserted into a stern base receiving connector electrical socket at the stern of a water vessel. As discussed elsewhere herein, the stern light may be retained into the stern base receiving connector electrical socket using a set screw. FIG. 10 illustrates the stern light mounted to the inside surface of a vessel engine cover, where the stern light is press fitted into clips affixed to the engine cover.

Figure 11:
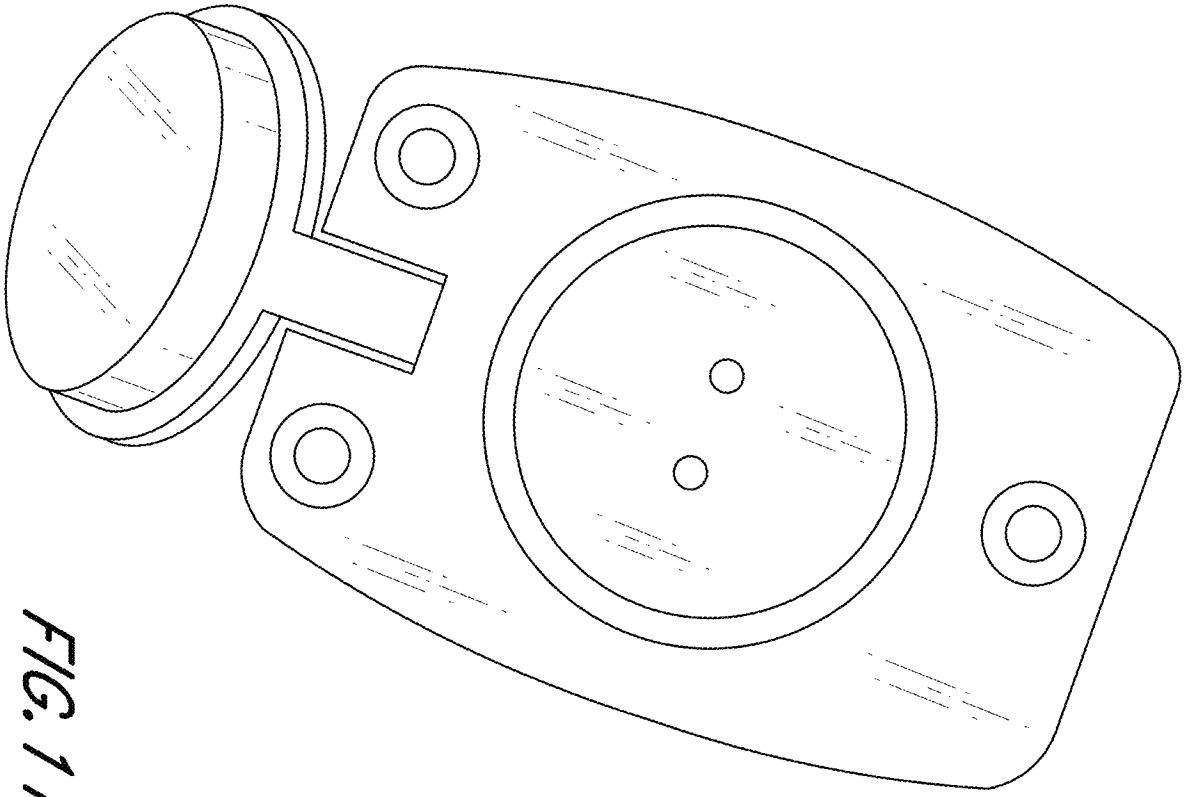
FIG. 11 illustrates an example socket configured to receive the lighting assembly connector.

FIG. 11 illustrates an example electrical socket configured to receive the stern light, where the socket includes two power pins (negative and positive power pins) configured to provide 12 VDC power to the stern light when the stern light is inserted into the socket. The socket is configured to be mounted to the stern of a vessel.

Although the foregoing examples may refer to stern lights, aspects of the foregoing configurations may be similarly utilized for other locations on a water vessel, and well as for non-water vessels. Further, although certain examples may refer to LED lighting elements, other lighting elements maybe utilized, such as neon lights.

While certain embodiments have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable sub combination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A stern lighting system configured for marine applications, the lighting system comprising:

a light strip support structure;

a first light strip comprising a first plurality of lighting elements, including light elements of different colors, the first light strip wrapped around the light strip support structure in a spiral manner;

a second light strip comprising a second plurality of lighting elements including lighting elements that emit only white light, the second light strip wrapped around the light strip support structure above the first light strip in a spiral manner;

a light element controller electrically connected to the first light strip, wherein the light element controller is configured to control illumination of the first plurality of lighting elements of the first light strip and not the second plurality of lighting elements of the second light strip;

a moisture resistant structure enclosing at least portions of the light strip support structure, the first light strip, and the second light strip; and an electrical connector configured to mate with a watercraft connector.

2. The lighting system as defined in claim 1, further comprising a base having at least two screw holes oppositely positioned from each other.

3. The lighting system as defined in claim 1, wherein the moisture resistant structure comprises a heat shrink material.

4. The lighting system as defined in claim 1, wherein power connections are daisy chained from the first light strip to the second light strip.

5. The lighting system as defined in claim 1, wherein the light strip support structure comprises a tube with power wires positioned therein.

6. The lighting system as defined in claim 1, wherein the first light strip comprises a plurality of light strips.

7. The lighting system as defined in claim 1, wherein the first light strip comprises white, red, green, blue, cyan, yellow, amber, orange, peach, purple, pink, forest green lighting elements.

8. The lighting system as defined in claim 1, wherein the second light strip is configured to automatically provide white light illumination when power is applied to the lighting system.

9. The lighting system as defined in claim 1, wherein the first plurality of lighting elements comprises a plurality of LEDs.

10. The lighting system as defined in claim 1, further comprising a remote control device configured to wirelessly transmit lighting instructions configured to control illumination of the first plurality of lighting elements, wherein the second plurality of lighting elements is not controllable via the remote control device.

11. The lighting system as defined in claim 1, further comprising a remote control device configured to wirelessly transmit lighting instructions configured to control illumination of the first plurality of lighting elements to cause at least a portion of the first plurality of lighting elements to illuminate in a first color, and a third plurality of lighting elements to illuminate in a second color.

12. The lighting system as defined in claim 1, further comprising a 2-pin power connector configured to be inserted into a socket positioned on a stern of a vessel.

13. The lighting system as defined in claim 1, wherein the lighting system does not include a manual, wired on/off switch.

14. A stern lighting system configured for marine applications, the lighting system comprising:

a light strip support structure;

a first light strip comprising a first plurality of lighting elements, including light elements of different colors;

a second light strip comprising a second plurality of lighting elements, the second light strip positioned above the first light strip;

a light element controller electrically connected to the first light strip, wherein the light element controller is configured to control the illumination of the first plurality of lighting elements and not the second plurality of lighting elements; and a connector configured to mate with a watercraft stern connector.

15. The stern lighting system as defined in claim 14, further comprising a base having at least two screw holes oppositely positioned from each other.

16. The stern lighting system as defined in claim 14, further comprising a water-resistant enclosure.

17. The stern lighting system as defined in claim 14, wherein the first light strip is spiraled about the light strip support structure, and the second light strip is spiraled about the light strip support structure above the first light strip.

18. The stern lighting system as defined in claim 14, wherein the light strip support structure is a transparent tube, and the first light strip is positioned in a planar manner on an interior surface of the transparent tube light strip support structure.

19. The stern lighting system as defined in claim 14, wherein the light strip support structure comprises a tube with power wires positioned therein.

20. The stern lighting system as defined in claim 14, wherein the first light strip is comprises a plurality of light strips.

21. The stern lighting system as defined in claim 14, wherein the first light strip comprises white, red, green, blue, cyan, yellow, amber, orange, peach, purple, pink, and/or forest green.

22. The stern lighting system as defined in claim 14, wherein the light strip support structure is a transparent tube, the stern lighting system further comprising:

a cap configured to seal a top opening of the tube.

23. The stern lighting system as defined in claim 14, wherein the second light strip is configured to automatically provide white light illumination when power is applied to the stern lighting system.

24. The stern lighting system as defined in claim 14, wherein the first plurality of lighting elements comprises a plurality of LEDs.

25. The stern lighting system as defined in claim 14, further comprising a remote control device configured to wirelessly transmit lighting instructions configured to control illumination of the first plurality of lighting elements, wherein the second plurality of lighting elements is not controllable via the remote control device.

26. The stern lighting system as defined in claim 14, further comprising a remote control device configured to wirelessly transmit lighting instructions configured to control illumination of the first plurality of lighting elements to cause at least a portion of the first plurality of lighting elements to illuminate in a first color, and a second third plurality of lighting elements to illuminate in a second color.

27. The stern lighting system as defined in claim 14, further comprising a 2-pin power connector configured to be inserted into a stern light receiving socket.

28. The stern lighting system as defined in claim 14, wherein the stern lighting system does not include a manual, wired on/off switch.

* * * * *